US012448737B2

(12) United States Patent
Wang et al.

(10) Patent No.: US 12,448,737 B2
(45) Date of Patent: Oct. 21, 2025

(54) GUIDE RAIL BEAM, TRACK BEAM UNIT, AND TRACK BEAM FOR RAIL VEHICLE

(71) Applicant: BYD COMPANY LIMITED, Guangdong (CN)

(72) Inventors: Saining Wang, Shenzhen (CN); Xiaotong Liu, Shenzhen (CN); Jing Yang, Shenzhen (CN); Dandan Guan, Shenzhen (CN); Danli Wu, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 769 days.

(21) Appl. No.: 17/764,080

(22) PCT Filed: Sep. 23, 2020

(86) PCT No.: PCT/CN2020/117138
§ 371 (c)(1),
(2) Date: Mar. 25, 2022

(87) PCT Pub. No.: WO2021/063226
PCT Pub. Date: Apr. 8, 2021

(65) Prior Publication Data

US 2022/0389663 A1 Dec. 8, 2022

(30) Foreign Application Priority Data

Sep. 30, 2019 (CN) ..... 201910941146.9

(51) Int. Cl.
*E01B 25/24* (2006.01)
*E01B 25/28* (2006.01)

(52) U.S. Cl.
CPC ..... *E01B 25/24* (2013.01); *E01B 25/28* (2013.01)

(58) Field of Classification Search
CPC ..... E01B 25/24; E01B 25/28
See application file for complete search history.

(56) References Cited

U.S. PATENT DOCUMENTS

2022/0389663 A1* 12/2022 Wang ..... E01B 25/00
2023/0203758 A1* 6/2023 Xia ..... B61F 9/00 238/130

FOREIGN PATENT DOCUMENTS

CN 1871403 A * 11/2006
CN 201400850 Y 2/2010
(Continued)

OTHER PUBLICATIONS

International Search Report and Written Opinion for Application No. PCT/CN2020/117138, mailed on Dec. 18, 2020, 11 pages.
(Continued)

*Primary Examiner* — Jason C Smith
(74) *Attorney, Agent, or Firm* — Sheppard Mullin Richter & Hampton LLP

(57) ABSTRACT

A guide rail beam (10), a track beam unit (100), and a track beam (1000) for a rail vehicle (7) are disclosed. The guide rail beam (10) includes a fixing plate (1), a flange plate (2), a web plate (3), and a stiffening rib (5). The fixing plate (1) is disposed on a mounting surface (20). The flange plate (2) is disposed above the fixing plate (1). A road wheel (71) travels on the flange plate (2). An upper end of the web plate (3) is connected with the flange plate (2), and a lower end of the web plate (3) is connected with the fixing plate (1). The web plate (3) is in contact with and be associated with a guide wheel (72) to guide a traveling track of the guide wheel (72). An upper end of the stiffening rib (5) is connected with the flange plate (2), and a lower end of the stiffening rib (5) is connected with the fixing plate (1).

20 Claims, 6 Drawing Sheets

(56) References Cited

FOREIGN PATENT DOCUMENTS

| | | | | | |
|---|---|---|---|---|---|
| CN | 106638175 | A | * | 5/2017 | |
| CN | 108130852 | A | * | 6/2018 | |
| CN | 207449912 | U | | 6/2018 | |
| CN | 208250833 | U | * | 12/2018 | |
| CN | 208250912 | U | | 12/2018 | |
| CN | 208472484 | U | * | 2/2019 | |
| CN | 208665197 | U | | 3/2019 | |
| CN | 208762797 | U | | 4/2019 | |
| CN | 209010948 | U | * | 6/2019 | |
| CN | 209052953 | U | | 7/2019 | |
| CN | 112239975 | A | * | 1/2021 | ..... E01B 25/24 |
| CN | 112575675 | B | * | 3/2022 | ..... E01D 19/02 |
| CN | 216275184 | U | * | 4/2022 | |
| CN | 115354529 | A | * | 11/2022 | |
| CN | 218466311 | U | * | 2/2023 | |
| JP | 2004137686 | A | | 5/2004 | |
| JP | 2007006719 | A | | 1/2007 | |
| JP | 2016049840 | A | | 4/2016 | |
| KR | 20180023157 | A | | 3/2018 | |
| WO | WO-2018121502 | A1 | * | 7/2018 | |
| WO | WO-2019223677 | A1 | * | 11/2019 | |
| WO | WO-2021063225 | A1 | * | 4/2021 | ..... E01B 2/00 |
| WO | WO-2021063226 | A1 | * | 4/2021 | ..... E01B 25/24 |

OTHER PUBLICATIONS

Kinbin Yang. "Medium and Low Speed Maglev Traffic Technology", Chapter 2, Assembly of Medium and Low Speed Maglev Traffic, Tongji University Press, p. 26.

* cited by examiner

GUIDE RAIL BEAM, TRACK BEAM UNIT, AND TRACK BEAM FOR RAIL VEHICLE

CROSS-REFERENCE TO RELATED APPLICATIONS

This application is a National Phase Application of International Patent Application No. PCT/CN2020/117138, filed on Sep. 23, 2020, which is based on and claims priority to and benefits of Chinese Patent Application No. 201910941146.9 filled on Sep. 30, 2019. The entire content of all of the above-identified applications is incorporated herein by reference.

FIELD

The disclosure relates to the field of rail transit, and more specifically, to a guide rail beam, a track beam unit, and a track beam for a rail vehicle.

BACKGROUND

With the continuous advancement of urbanization, rail vehicles can bring a lot of convenience to life and production. However, the construction technology of the track beam in related arts is complicated and inconvenient to operate. Therefore, the quality is difficult to guarantee, and costs are high, resulting in slow development of application of the rail vehicles.

SUMMARY

The disclosure is intended to resolve at least one of the technical problems existing in the related art.

The disclosure provides a track beam for a rail vehicle, which is simple in structure, easy to machine, and easy to guarantee the accuracy, saves materials, and is economical and practical.

The disclosure further provides a track beam unit for the rail vehicle having a guide rail beam.

The disclosure further provides a track beam for the rail vehicle having the track beam unit.

According to the guide rail beam for a rail vehicle in an embodiment of the disclosure, the rail vehicle includes a road wheel and a guide wheel located under the road wheel. The guide rail beam includes a fixing plate, a flange plate, a web plate, and a stiffening rib. The fixing plate is adapted to be disposed on a mounting surface. The flange plate is disposed above the fixing plate. The road wheel is adapted to travel on the flange plate. An upper end of the web plate is connected with the flange plate, and a lower end of the web plate is connected with the fixing plate. The web plate is adapted to come into contact with and be associated with the guide wheel to guide a traveling track of the guide wheel. An upper end of the stiffening rib is connected with the flange plate, and a lower end of the stiffening rib is connected with the fixing plate.

According to the guide rail beam for a rail vehicle in an embodiment of the disclosure, the flange plate of the guide rail beam is supported on the fixing plate by using the web plate. In this way, it is ensured that the flange plate can stably support a lower part of the rail vehicle. In addition, the association of the guide wheel and the web plate also guarantees that the traveling track of the rail vehicle does not deviate while the rail vehicle is smoothly traveling on the track beam. A constructor may conveniently implement operations such as welding between plates of the guide rail beam, so as to facilitate processing and easily guarantee the quality. In addition, the guide rail beam for a rail vehicle in the disclosure is simple in structure, saves materials, and is economical and practical.

In some embodiments of the disclosure, a width direction of the stiffening rib is parallel to a width direction of the guide rail beam.

In some embodiments of the disclosure, the stiffening rib is connected with the web plate.

In some embodiments of the disclosure, a plurality of stiffening ribs are disposed. The plurality of stiffening ribs are spaced apart from each other in a length direction of the guide rail beam.

In some embodiments of the disclosure, a limiting flange is disposed on the flange plate, and is adapted to be located above the guide wheel.

In some embodiments of the disclosure, the web plate is disposed off a width center of the flange plate in the width direction of the guide rail beam.

The track beam unit for a rail vehicle according to the embodiment of the disclosure includes two guide rail beams. The two guide rail beams are spaced apart from each other in a width direction of the rail vehicle. The guide rail beams are the guide rail beams according to the above embodiments of the disclosure.

The track beam unit for a rail vehicle according to the embodiment of the disclosure includes two guide rail beams spaced apart from each other in the width direction of the rail vehicle. The flange plate of each of the guide rail beams is supported on the fixing plate by using the web plate, so as to ensure that the flange plate can stably support the lower part of the rail vehicle. In addition, the association of the guide wheel and the web plate guarantees that the traveling track of the rail vehicle does not deviate while the rail vehicle is smoothly traveling on the track beam unit. Therefore, the structure of the track beam unit of the disclosure is easy to machine, the quality is easy to ensure, and materials are saved, thereby achieving the economy and practicality.

In some embodiments of the disclosure, the track beam unit further includes a connecting member. The ends of the connecting member are respectively connected with a stiffening rib and a web plate of the two guide rail beams. Alternatively, the ends of the connecting member are respectively connected with a stiffening rib or a web plate of the two guide rail beams.

In some embodiments of the disclosure, a plurality of connecting members are disposed, a plurality of stiffening ribs are disposed, and a number of the connecting members is same as a number of the stiffening ribs of each of the guide rail beams.

In some embodiments of the disclosure, a reinforcing plate is disposed on each of the stiffening ribs.

In some embodiments of the disclosure, the reinforcing plate includes an upper plate body and a lower plate body. The connecting member is an I-shaped steel member. The upper plate body is flush with an upper flange of the connecting member, and the lower plate body is flush with a lower flange of the connecting member.

In some embodiments of the disclosure, the track beam unit further includes a supporting member. The supporting member is disposed on the connecting member. An evacuation exit is defined by an upper space of the supporting member.

In some embodiments of the disclosure, a cable channel is disposed in the evacuation exit, and is disposed close to the web plate.

In some embodiments of the disclosure, an anti-slip layer is disposed on a surface of the flange plate associated with the road wheel.

The track beam for a rail vehicle according to the embodiment of the disclosure includes a plurality of track beam units. The plurality of track beam units are connected in sequence in a length direction of the track beam units, and the track beam units are the track beam units according to the above embodiments of the disclosure.

The track beam for a rail vehicle according to the embodiment of the disclosure includes the plurality of track beam units connected in sequence. The flange plate of each guide rail beam is supported on the fixing plate by using the web plate, so as to ensure that the flange plate can stably support the lower part of the rail vehicle. A guide plate is connected with a lower part of the flange plate. The association of the guide wheel and the guide plate also guarantees that the traveling track of the rail vehicle does not deviate while the rail vehicle is smoothly traveling on the track beam. Therefore, the track beam unit of the disclosure is more adapted to the rail vehicle. In addition, the track beam for a rail vehicle according to the embodiments of the disclosure is easy to machine, easy to guarantee the quality, and simple in structure, saves materials, and is economical and practical.

Additional aspects and advantages of the disclosure will be given in the following description, some of which will become apparent from the following description or may be learned from practices of the disclosure.

BRIEF DESCRIPTION OF THE DRAWINGS

The foregoing and/or additional aspects and advantages of the disclosure will become apparent and comprehensible in the description of the embodiments made with reference to the following accompanying drawings.

REFERENCE NUMERALS

Figure 1:
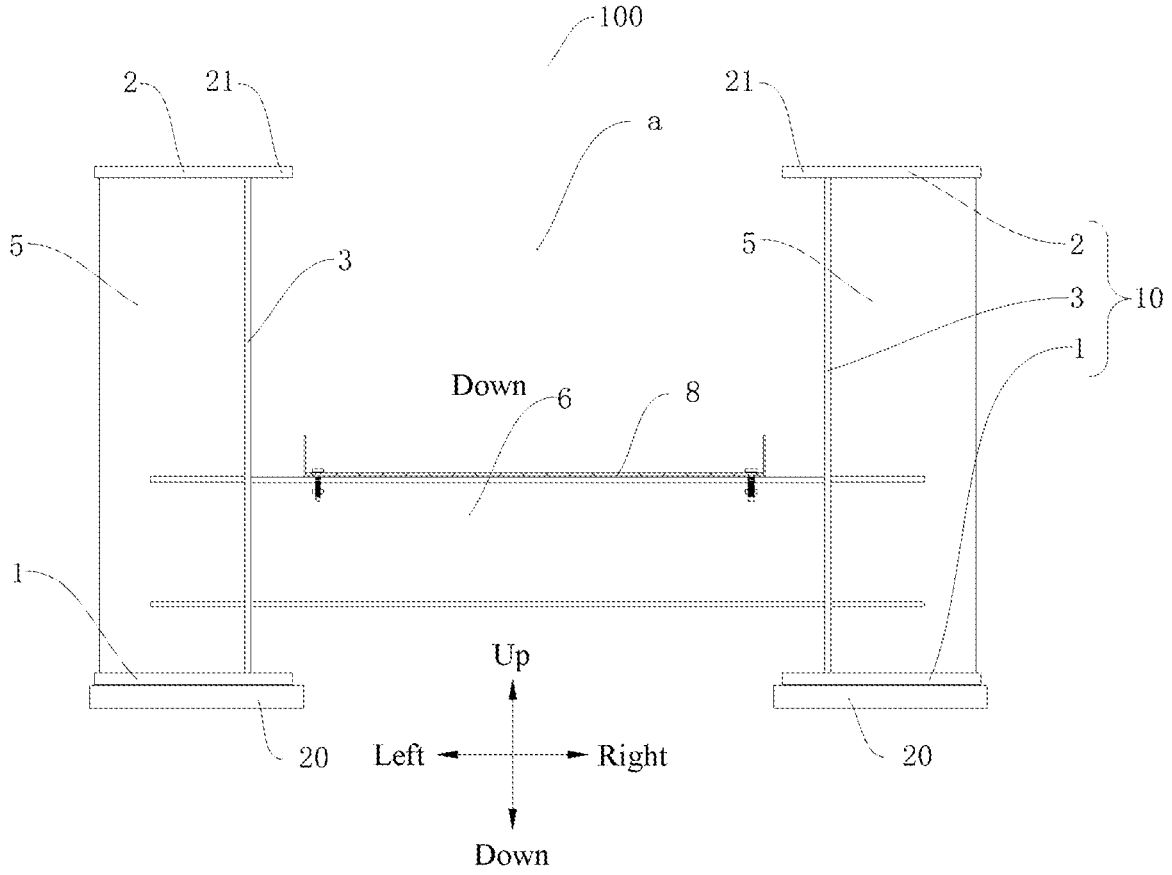
FIG. 1 is a schematic diagram of a track beam unit according to an embodiment of the disclosure.

1000. Track beam;
100. Track beam unit;
10. Guide rail beam;
20. Mounting surface;
1. Fixing plate;
2. Flange plate;
21. Limiting flange;
22. Anti-slip layer;
3. Web plate;
4. Reinforcing plate;
41. Upper plate body;
42. Lower plate body;
5. Stiffening rib;
6. Connecting member;
61. Upper flange;
62. Lower flange;
7. Rail vehicle;
71. Road wheel;
72. Guide wheel;
8. Supporting member;
a. Evacuation exit.

DETAILED DESCRIPTION

The following describes embodiments of the disclosure in detail. Examples of the embodiments are shown in the accompanying drawings, and same or similar reference signs in all the accompanying drawings indicate same or similar components or components having same or similar functions. The embodiments described below with reference to the accompanying drawings are exemplary and used only for explaining the disclosure, and should not be construed as a limitation on the disclosure.

In the description of the disclosure, it should be understood that orientation or position relationships indicated by the terms such as "center", "longitudinal", "transverse", "length", "width", "thickness", "on", "below", "front", "back", "left", "right", "vertical", "horizontal", "top", "bottom", "inside", "outside", "clockwise", "anticlockwise", "axial direction", "radial direction", and "circumferential direction" are based on orientation or position relationships shown in the accompanying drawings, and are used only for ease and brevity of illustration and description, rather than indicating or implying that the mentioned apparatus or component needs to have a particular orientation or needs to be constructed and operated in a particular orientation. Therefore, such terms should not be construed as limiting of the disclosure. In addition, a feature defined to be "first" or "second" may explicitly or implicitly include one or more features. In the description of the disclosure, unless otherwise stated, "a plurality of" means two or more than two.

In the description of the disclosure, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. A person of ordinary skill in the art may understand the specific meanings of the foregoing terms in the disclosure according to specific situations.

A guide rail beam 10 for a rail vehicle 7 according to embodiments of the disclosure is described with reference to descriptions of FIG. 1 to FIG. 10. The rail vehicle 7 is adapted to travel on the guide rail beam 10. Specifically, the rail vehicle 7 includes road wheels 71 and guide wheels 72 located under the road wheels 71. It may be understood that, the rail vehicle 7 further includes a vehicle body. The road wheels 71 and the guide wheels 72 are respectively disposed on the vehicle body.

The guide rail beam 10 of the rail vehicle 7 according to an embodiment of the disclosure includes a fixing plate 1, a flange plate 2, a web plate 3, and a stiffening rib 5. The fixing plate 1 is adapted to be disposed on a mounting surface 20 (as shown in FIG. 1). The mounting surface 20 may be a position such as a top portion of a pier stud, a top portion of a bent cap, a mounting surface 20 of a beam support, or the like for mounting the guide rail beam 10. Specifically, the fixing plate 1 may be mounted to the mounting surface 20 by using a screw bolt assembly.

The flange plate 2 is disposed above the fixing plate 1. Each of the road wheels 71 is adapted to travel on the flange plate 2. An upper end of the web plate 3 is connected with the flange plate 2, and a lower end of the web plate 3 is connected with the fixing plate 1. The web plate 3 is adapted to come into contact with and be associated with each of the guide wheels 72 to guide a traveling track of the guide wheel 72.

An upper end of the stiffening rib 5 is connected with the flange plate 2, and a lower end of the stiffening rib 5 is connected with the fixing plate 1. That is to say, the stiffening rib 5 is connected between the flange plate 2 and the fixing plate 1, to cause the flange plate 2 to be supported above the fixing plate 1 more firmly. Therefore, each guide rail beam 10 can be firmer, thereby improving the overall stability of the guide rail beams 10.

That is to say, when the rail vehicle 7 travels on the guide rail beam 10, the road wheel 71 travels on an upper surface of the flange plate 2, and the guide wheel 72 is in contact with the web plate 3 under the flange plate 2 in a width direction of the vehicle body, so as to achieve an effect of guiding a traveling track of the rail vehicle 7.

Figure 5:
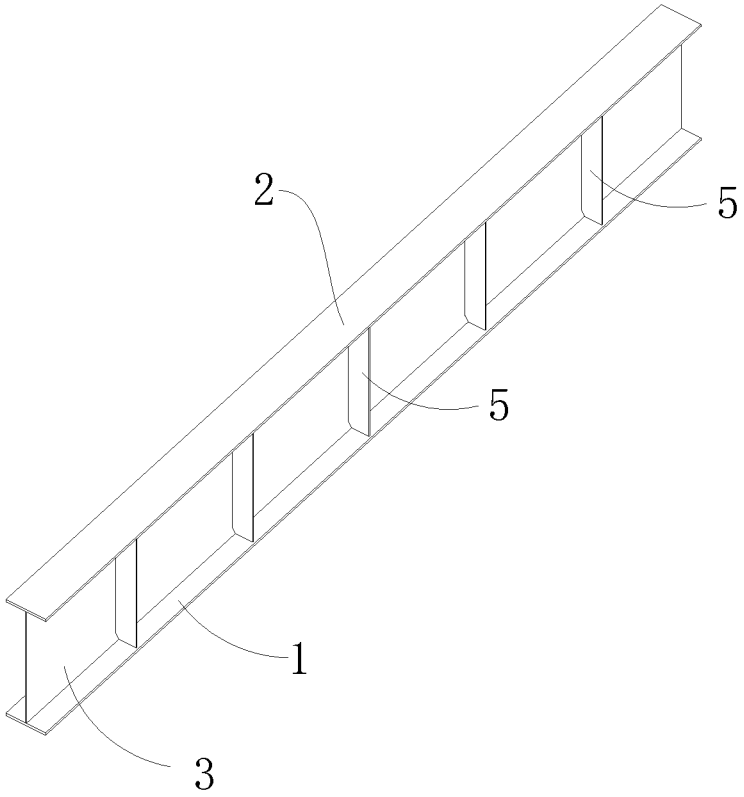
FIG. 5 is a schematic diagram of a guide rail beam according to an embodiment of the disclosure.
Figure 6:
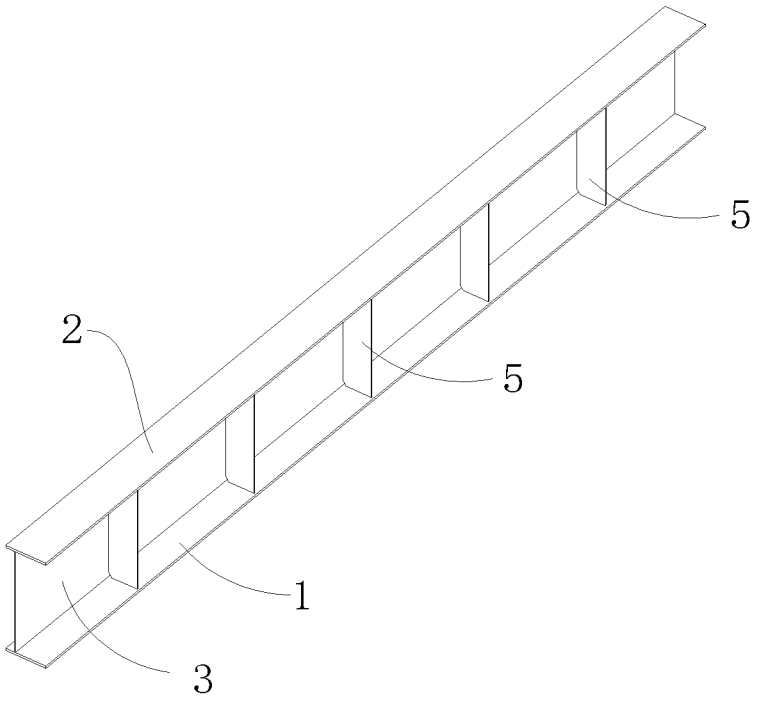
FIG. 6 is a schematic diagram of a guide rail beam according to another embodiment of the disclosure.

In brief, the web plate 3 not only has a function of connecting the flange plate 2 to the fixing plate 1, but also has an effect of guiding the traveling track of the rail vehicle 7, so that the web plate 3 not only can guarantee the stability of the guide rail beam 10, but also can guide the traveling of the rail vehicle 7. In addition, the guide rail beam 10 is simple in structure, which only includes the fixing plate 1, the flange plate 2, the web plate 3, and the stiffening rib 5. As shown in FIG. 5 and FIG. 6, the entire guide rail beam 10 is an open beam body, so that a constructor has enough operating space to perform fixation processes such as the welding between plates. Therefore, the guide rail beam is easy to machine, and the quality of welding is easily guaranteed. In addition, welding workloads are greatly reduced, the quality of the guide rail beam is easy to guarantee, and the assembling of the entire track beam is facilitated. In this way, the quality and accuracy of the entire track beam can be guaranteed.

Especially for the guide rail beams 10 with certain sizes, for example, a guide rail beam 10 having a narrow width and a limited height, since a box beam in related arts is a closed beam body, operations such as the welding between components of the box beam are very inconvenient, and the operating space is very limited. Therefore, the construction is very complicated, the efficiency is low, and the quality is difficult to guarantee. However, the guide rail beam 10 in the embodiment of the disclosure is the open beam body, so that the constructor can conveniently perform operations such as welding. Therefore, the guide rail beam is easy to machine, and the quality is easy to guarantee.

In addition, compared with the box beam in related arts, the steel consumption of the guide rail beam 10 is greatly saved, and the weight of the beam body is light, which simultaneously achieves the economy and practicality. Moreover, most guide rail beams 10 may be prefabricated in a factory, and then transported to a site for assembly, thereby achieving a short engineering cycle, strong adaptability, and convenient transportation. Therefore, the on-site hoisting and the accuracy control of the guide rail beam 10 are facilitated.

According to the guide rail beam 10 for a rail vehicle 7 in an embodiment of the disclosure, the flange plate 2 of the guide rail beam 10 is supported on the fixing plate 1 by using the web plate 3. In this way, it ensures that the flange plate 2 can stably support a lower part of the rail vehicle 7. In addition, the association of the guide wheel 72 and the web plate 3 also guarantees that the traveling track of the rail vehicle 7 does not deviate while the rail vehicle 7 is smoothly traveling on the guide rail beam 10. The structure of the guide rail beam 10 is easy to machine and saves materials, and the guide rail beam 10 of the disclosure is more applicable to the rail vehicle 7.

In some embodiments of the disclosure, as shown in FIG. 5 and FIG. 6, a width direction of the stiffening rib 5 is parallel to a width direction of the guide rail beam 10. That is to say, the stiffening rib 5 may extend in the width direction of the guide rail beam 10, and the web plate 3 may extend in a length direction of the guide rail beam 10. Therefore, the flange plate 2 can be stably connected above the fixing plate 1. In this way, the steel consumption of the guide rail beam 10 is also saved while stabilizing the guide rail beam 10.

As shown in FIG. 5, in some embodiments of the disclosure, the flange plate 2 has a center line at the width direction of the flange plate 2, and the web plate 3 may be disposed along the center line, so as to ensure that the web plate 3 supports the flange plate 2 more smoothly.

As shown in FIG. 1, in some embodiments of the disclosure, the stiffening rib 5 is connected with the web plate 3. That is to say, the combination of the web plate 3 and the stiffening rib 5 can cause part of the web plate 3 to be more stable, thereby causing the connection between the flange plate 2 and the fixing plate 1 to be more stable. In addition, the association between the guide wheel 72 and the web plate 3 can be more reliable. In some specific embodiments of the disclosure, the web plate 3 is connected on a side of one of the stiffening ribs 5 facing the other of the stiffening ribs 5. That is to say, the two web plates 3 are disposed facing each other, thereby further ensuring better association between the guide wheel 72 and the web plate 3. Definitely, the web plate 3 may also be disposed on a side of one of the stiffening ribs 5 away from the other of the stiffening ribs 5, such that, the guide rail beam is applicable to a rail vehicle having the guide wheel located outside the track beam.

In some embodiments of the disclosure, as shown in FIG. 5 and FIG. 6, a plurality of stiffening ribs 5 are disposed. The plurality of stiffening ribs 5 are spaced apart from each other in the length direction of the guide rail beam 10. That is to say, the plurality of stiffening ribs 5 are spaced apart from each other in the length direction of the guide rail beam 10 between the flange plate 2 and the fixing plate 1, thereby further ensuring the stability of the guide rail beam 10. It is to be noted that, a number of the stiffening ribs 5 may be adjusted according to a height of the guide rail beam 10 and a thickness of the web plate 3, which is not limited herein.

Figure 3:
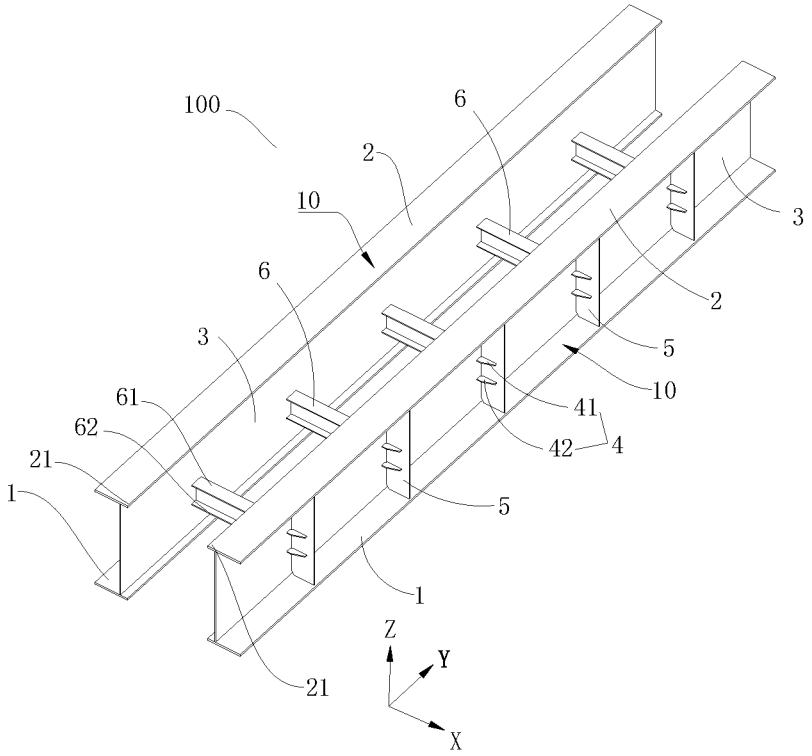
FIG. 3 is a three-dimensional schematic structural diagram of a track beam unit according to an embodiment of the disclosure.

As shown in FIG. 3, the track beam unit 100 for a rail vehicle 7 according to the embodiment of the disclosure includes two guide rail beams 10. The two guide rail beams 10 are spaced apart from each other in a width direction of the rail vehicle 7. Each of the guide rail beams 10 includes the fixing plate 1, the flange plate 2, the web plate 3, and the stiffening rib 5. The fixing plate 1 is adapted to be disposed on a mounting surface 20. The mounting surface 20 may be a position such as a top portion of a pier stud, a top portion of a bent cap, a mounting surface 20 of a beam support, or the like for mounting the track beam unit 100. Specifically, the fixing plate 1 may be mounted to the mounting surface 20 by using a screw bolt assembly.

The flange plate 2 is disposed above the fixing plate 1. The road wheel 71 travels on the flange plate 2. An upper end of the web plate 3 is connected with the flange plate 2, and a lower end of the web plate 3 is connected with the fixing plate 1. The web plate 3 is in contact with the guide wheel 72 to guide a traveling track of the guide wheel 72. Specifically, the fixing plate 1 is located under the flange plate 2 in an up-down direction (a Z-axis direction shown in FIG. 3). The track beam unit 100 is fixed to the mounting surface 20 by mounting the fixing plate 1 to the mounting surface 20. The upper end of the web plate 3 is connected with the flange plate 2, and the lower end of the web plate 3 is connected with the fixing plate 1. In this way, it can be ensured that the flange plate 2 stably supports the lower part of the rail vehicle 7. In addition, through the association of the guide wheel 72 and the web plate 3 also ensures that the traveling track of the rail vehicle 7 does not deviate.

Figure 4:
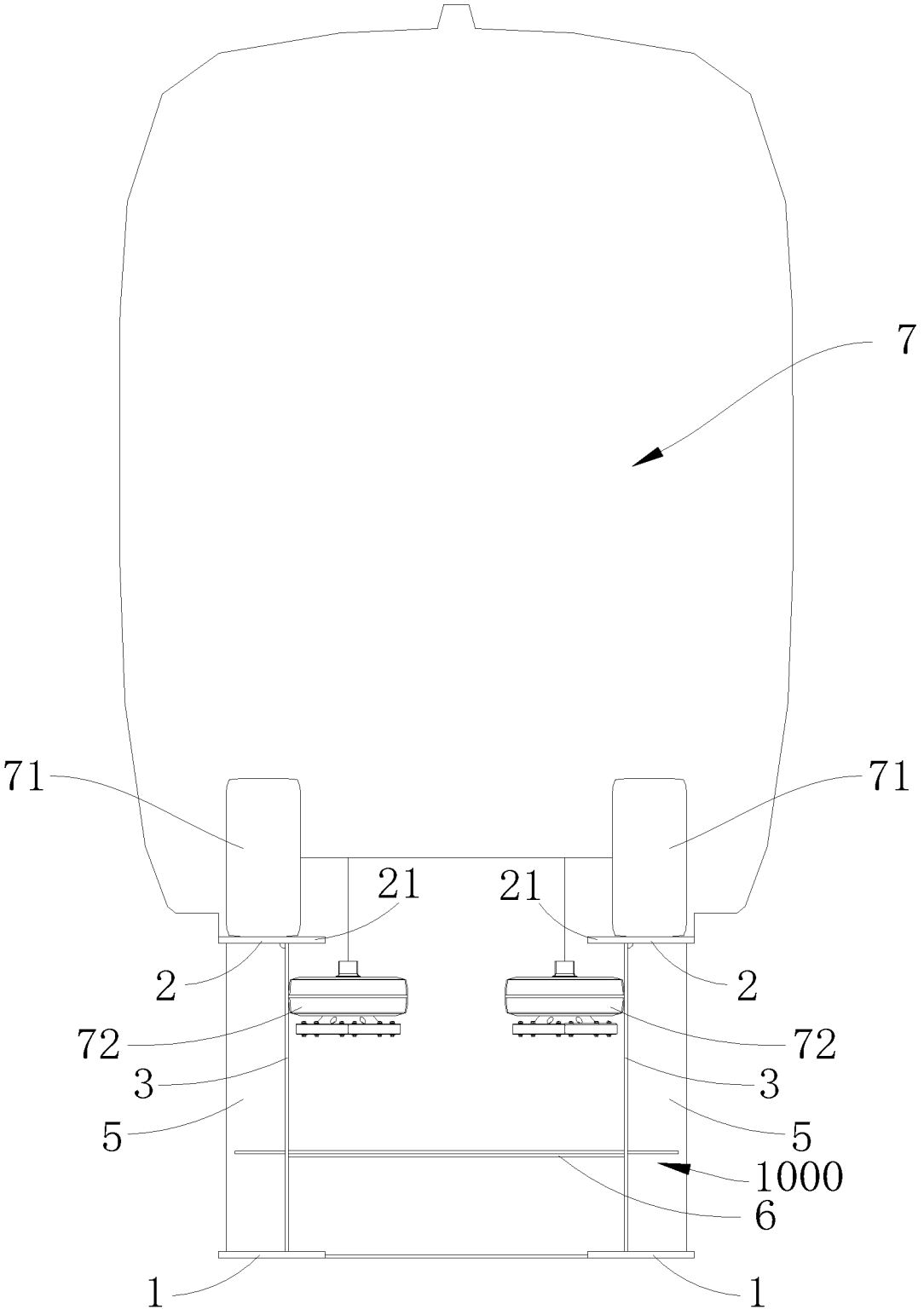
FIG. 4 is a schematic diagram of a rail vehicle traveling on a track beam according to an embodiment of the disclosure.

As shown in FIG. 3 and FIG. 4, the two guide rail beams 10 are spaced apart from each other in the width direction (an X-axis direction shown in FIG. 3) of the vehicle body. When the rail vehicle 7 travels on the track beam 1000, the road wheel 71 travels on the upper surface of the flange plate 2, and the guide wheel 72 extends between the two guide rail beams 10. In this way, the guide wheel 72 is in contact with the web plate 3 under the flange plate 2, so as to guide the traveling track of the rail vehicle 7.

In brief, the web plate 3 not only has a function of connecting the flange plate 2 to the fixing plate 1, but also has an effect of guiding the traveling track of the rail vehicle 7, so that the web plate 3 not only can guarantee the stability of the guide rail beam 10, but also can guide the traveling of the rail vehicle 7. Therefore, the guide rail beam 10 is easy to machine, and the quality is easy to guarantee. In this way, the steel consumption of the guide rail beam 10 is saved, and the economy is realized. Most guide rail beams 10 can be assembled in a factory, which facilitates the on-site hoisting and the accuracy control of the guide rail beam 10.

According to the track beam unit 100 for a rail vehicle 7 in an embodiment of the disclosure, the track beam unit 100 includes two guide rail beams 10 spaced apart from each other in the width direction of the rail vehicle 7. The flange plate 2 of each guide rail beam 10 is supported on the fixing plate 1 by using the web plate 3, so that the flange plate 2 can be stably supported under the rail vehicle 7. Through the association of the guide wheel 72 and the web plate 3, the traveling track of the rail vehicle 7 can be guaranteed to not deviate while the rail vehicle 7 is smoothly and stably driven on the track beam 1000, so that a structure of the track beam unit 100 leads to an easy process and saves materials. Therefore, the track beam unit 100 is more applicable to the rail vehicle 7.

Figure 9:
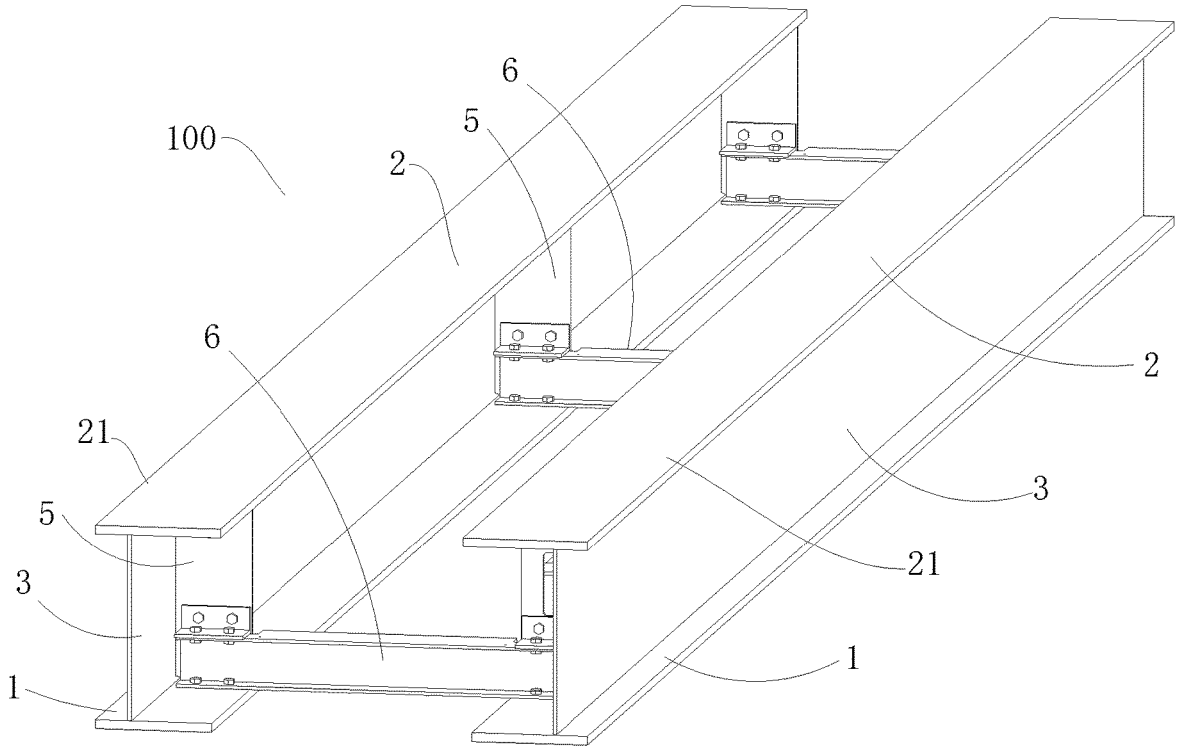
FIG. 9 is a schematic diagram of a track beam unit according to another embodiment of the disclosure.

As shown in FIG. 6, in some embodiments of the disclosure, the web plate 3 is disposed off a width center of the flange plate 2 in the width direction of the guide rail beam 10. That is to say, the flange plate 2 has the center line at the width direction of the flange plate 2, and the web plate 3 may be disposed off the center line. Specifically, as shown in FIG. 1 to FIG. 4, the web plate 3 of one of the guide rail beams 10 is disposed close to the web plate 3 of the other of the guide rail beams 10. Alternatively, as shown in FIG. 9, the web plate 3 of one of the guide rail beams 10 is disposed away from the web plate 3 of the other of the guide rail beams 10, to increase an assembling space of the stiffening rib 5 and other assembly components and cause the assembly operation such as welding to be more convenient. In this way, the quality of products can be enhanced, and the welding workloads can be greatly reduced. thereby achieving easy machining and easy on-site assembling, ensuring the quality, and achieving high accuracy, safety, reliability, and endurance.

As shown in FIG. 3, in some embodiments of the disclosure, the web plate 3 of each guide rail beam 10 is located inside. In other words, the web plate 3 of one of the guide rail beams 10 of the track beam unit 100 is disposed on a side close to the other of the guide rail beams 10. The stiffening rib 5 of one of the guide rail beams 10 of the track beam unit 100 is disposed on a side away from the other of the guide rail beams 10. In this way, the track beam unit is applicable to the rail vehicle 7 having the guide wheel 72 located inside the guide rail beam 10. As shown in FIG. 9, in some embodiments of the disclosure, the web plate 3 of each guide rail beam 10 is located outside. In other words, the web plate 3 of one of the guide rail beams 10 of the track beam unit 100 is disposed on a side away from the other of the guide rail beams 10. The stiffening rib 5 of one of the guide rail beams 10 of the track beam unit 100 is disposed on a side close to the other of the guide rail beams 10. In this way, the two web plates 3 of the track beam unit 100 are both located outside, so that the track beam unit is applicable to the rail vehicle 7 having the guide wheel 72 located outside the guide rail beam 10. Therefore, the track beam unit may be applicable to different types of rail vehicles 7, and is more adaptable.

As shown in FIG. 1 and FIG. 4, in some embodiments of the disclosure, a limiting flange 21 is disposed on the flange plate 2. The limiting flange 21 is adapted to be located above the guide wheel 72. That is to say, the limiting flange 21 is disposed on the flange plate 2, and is located above the guide wheel 72. In an extreme case, when the rail vehicle 7 overturns, the limiting flange 21 may form a safety line to block the guide wheel 72. It is to be noted that, a width of the limiting flange 21 matches a radius of the guide wheel 72. The width of the limiting flange 21 is a distance by which the flange plate 2 extends from the web plate 3 in the width direction of the guide rail beam 10. The width of the limiting flange 21 matches the radius of the guide wheel 72 means that the width of the limiting flange 21 may block the guide wheel 72 and is less than the radius of the guide wheel 72, to avoid interference with an axle of the guide wheel 72, thereby better preventing the guide wheel 72 from disengaging from the guide rail beam 10.

As shown in FIG. 1 to FIG. 3 and FIG. 9, in some embodiments of the disclosure, the track beam unit 100 further includes a connecting member 6. One end of the connecting member 6 is connected with a stiffening rib 5 and a web plate 3 of one of the two guide rail beams 10, and the other end of the connecting member 6 is connected with a stiffening rib 5 and a web plate 3 of the other one of the two guide rail beams 10. Alternatively, one end of the connecting member 6 is connected with a stiffening rib 5 or a web plate 3 of one of the two guide rail beams 10, and the other end of the connecting member 6 is connected with a stiffening rib 5 or a web plate 3 of the other one of the two guide rail beams 10. That is to say, the connecting member 6 is disposed between the two guide rail beams 10. The two ends of the connecting member 6 are both connected with the web plates 3 of the two guide rail beams 10, or the two ends of the connecting member 6 are both connected with the stiffening ribs 5 of the two guide rail beams 10, or the ends of the connecting member 6 are simultaneously connected with the web plates 3 and the stiffening ribs 5. Therefore, the two guide rail beams 10 can work in coordination, which enhances the overall stability of the track beam unit 100.

Figure 2:
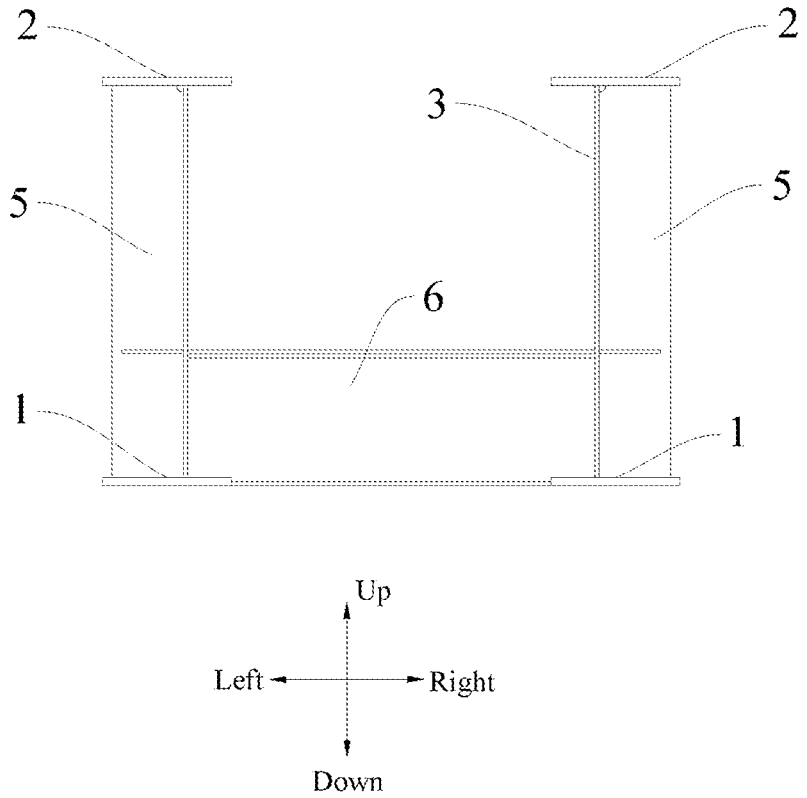
FIG. 2 is a schematic diagram of a track beam unit according to another embodiment of the disclosure.

It may be understood that, as shown in FIG. 1, the connecting member 6 is connected with the web plate 3 by welding. As shown in FIG. 2, an upper part of the connecting member 6 is fixed to the web plate 3 by welding, and a lower part of the connecting member 6 is fixed to the fixing plate 1 by welding. A connection manner of the connecting member 6 and the guide rail beams 10 is not limited herein.

In some embodiments of the disclosure, a plurality of connecting members 6 are disposed, and a plurality of stiffening ribs 5 are disposed. The number of the connecting members 6 is the same as the number of the stiffening ribs 5 of each guide rail beam 10. That is to say, a plurality of connecting members 6 are connected between the two guide rail beams 10 in the length direction of the guide rail beam 10. A plurality of stiffening ribs 5 are connected between the flange plate 2 and the fixing plate 1. The number of the connecting members 6 is the same as the number of the stiffening ribs 5 of each guide rail beam 10. In this way, the two ends of each connecting member 6 are both connected to the stiffening ribs 5 of the two guide rail beams 10, thereby further enhancing the stability of the track beam unit 100.

As shown in FIG. 3, in some embodiments of the disclosure, a reinforcing plate 4 is disposed on the stiffening rib 5. It may be understood that the reinforcing plate 4 may be connected with the stiffening rib 5 and the web plate 3 respectively, thereby enhancing the local strength of the stiffening rib 5, to avoid local damage. In this way, stress on the connecting member 6 can be better transferred to the guide rail beam 10, so as to enhance the overall coordination and stability of the track beam unit 100.

Figure 7:
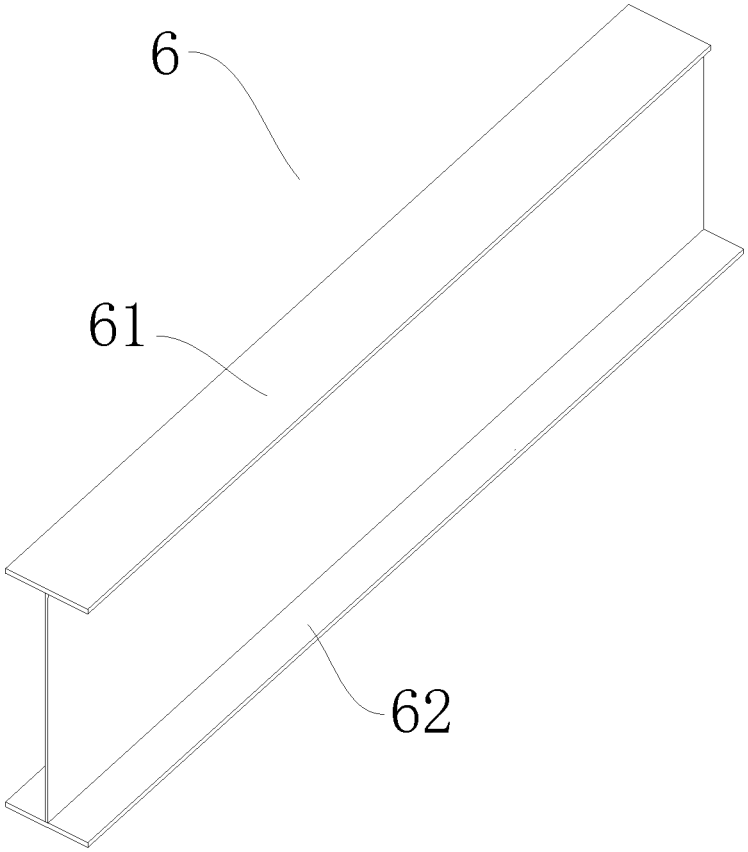
FIG. 7 is a schematic diagram of a connecting member according to an embodiment of the disclosure.

In some embodiments of the disclosure, as shown in FIG. 7 and FIG. 9, the connecting member 6 is an I-shaped steel member. The I-shaped steel member can be better attached to the stiffening rib 5 by cutting off half flange of an end portion of the I-shaped steel member. The I-shaped steel member may be connected with the web plate 3 or the stiffening rib 5 or the fixing plate 1 by using bolts or by welding. In this way, the connecting member 6 can be stably connected between the two guide rail beams 10, so as to enhance the overall stability of the track beam unit 100.

As shown in FIG. 3 and FIG. 6, in some embodiments of the disclosure, the reinforcing plate 4 includes an upper plate body 41 and a lower plate body 42. The connecting member 6 is the I-shaped steel member. The upper plate body 41 is flush with an upper flange 61 of the connecting member 6, and the lower plate body 42 is flush with a lower flange 62 of the connecting member 6. That is to say, the reinforcing plate 4 is disposed at a position of the stiffening rib 5 corresponding to the connecting member 6. The reinforcing plate 4 includes the upper plate body 41 and the lower plate body 42 spaced apart from each other. The upper plate body 41 is flush with the upper flange 61 of the connecting member 6, and the lower plate body 42 is flush with the lower flange 62 of the connecting member 6. Therefore, the stress performance at a junction of the connecting member 6 is enhanced to avoid the local damage. In this way, the stress on the connecting member 6 can be better transferred to the guide rail beam 10, thereby enhancing the overall coordination and stability of the track beam unit 100.

Figure 8:
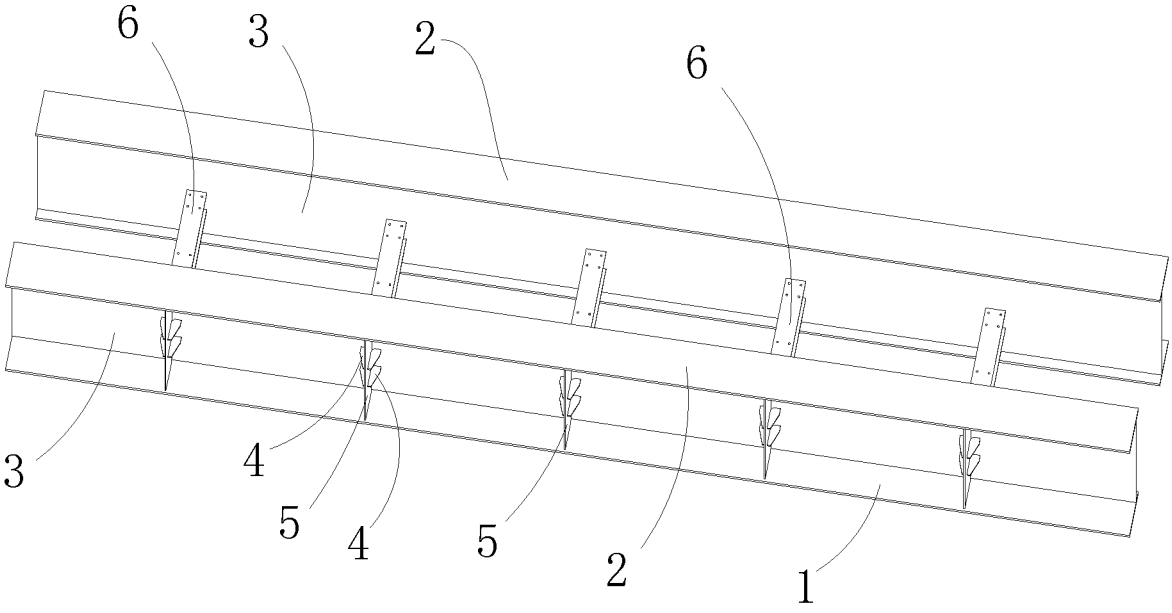
FIG. 8 is a three-dimensional schematic structural diagram of a track beam unit from another viewing angle according to an embodiment of the disclosure.

As shown in FIG. 8, in some embodiments of the disclosure, the reinforcing plate 4 is disposed on each of two opposite sides of the stiffening rib 5 to guarantee the strength of the stiffening rib 5. End portions of the connecting member 6 are connected to the web plate 3. The stiffening rib 5 and the connecting member 6 are disposed on two opposite sides of the web plate 3 facing each other. By using the reinforcing plates 4 to reinforce the stiffening rib 5, the junction of the connecting member 6 and the web plate 3 can be more stable. In addition, the web plate 3 may be prevented from local damage, so as to guarantee the stable association of the web plate 3 and the guide wheel.

As shown in FIG. 1, in some embodiments of the disclosure, the track beam unit 100 further includes a supporting member 8. The supporting member 8 is supported on the connecting member 6. An evacuation exit a is defined by an upper space of the supporting member 8. It may be understood that the supporting member 8 is connected with an upper part of the connecting member 6. The evacuation exit a is defined by the supporting member 8 and the web plate 3. Through the arrangement of the supporting member 8, maintenance personnel may walk on the supporting member 8 to facilitate maintenance of the track beam unit 100. In addition, if the rail vehicle 7 breaks down, passengers may be evacuated from the evacuation exit a. In some embodiments of the disclosure, the supporting member 8 may be a steel wire mesh or a steel grating. Definitely, the form of the supporting member 8 may be configured according to specific use conditions, which is not limited herein.

In some embodiments of the disclosure, a cable channel is disposed in the evacuation exit a, and is disposed close to the web plate 3. That is to say, the cable channel is formed at a position of the evacuation exit a close to the web plate 3. Therefore, it is convenient to lay dedicated cables such as communication cables, signal cables, and conductive cables in the cable channel, which greatly saves space. In some embodiments of the disclosure, a separator may be disposed in the evacuation exit a. The separator is disposed close to the web plate 3, so that the cable channel is formed between the separator and the web plate 3. Therefore, the dedicated cables such as communication cables, signal cables, and conductive cables are laid in the cable channel, so as to better protect the cables.

As shown in FIG. 1 and FIG. 4, in some embodiments of the disclosure, the web plate 3 of each guide rail beam 10 is located inside. The limiting flange 21 is disposed on a side of each flange plate 2 facing the other flange plate 2. The limiting flange 21 is adapted to be located above the guide wheel 72. That is to say, each flange plate 2 has the limiting flange 21 extending toward the other flange plate 2, and the limiting flange 21 is located above the guide wheel 72. In brief, a side of each flange plate 2 is beyond the web plate 3 in the width direction of the rail vehicle 7, to form the limiting flange 21. Therefore, in an extreme case, when the rail vehicle 7 overturns, the limiting flange 21 may form a safety line to block the guide wheel 72.

As shown in FIG. 9, in some embodiments of the disclosure, the web plate 3 of each guide rail beam 10 is located outside. The limiting flange 21 is disposed on the side of each flange plate 2 away from the other flange plate 2. The limiting flange 21 is adapted to be located above the guide wheel 72. That is to say, each flange plate 2 has the limiting flange 21 extending away from the other flange plate 2, and the limiting flange 21 is located above the guide wheel 72. In brief, the side of each flange plate 2 is beyond the web plate 3 in the width direction of the rail vehicle 7, to form the limiting flange 21. Therefore, in an extreme case, when the rail vehicle 7 overturns, the limiting flange 21 may form the safety line to block the guide wheel 72.

Figure 10:
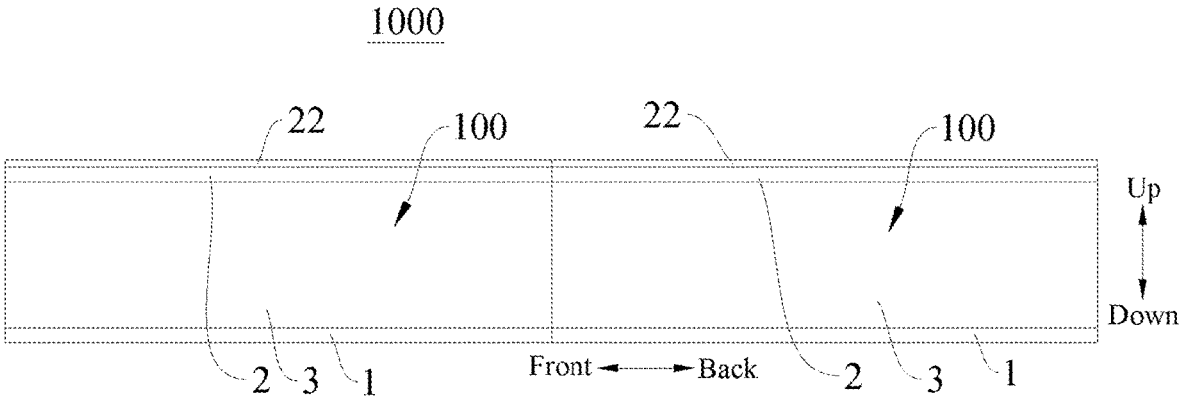
FIG. 10 is a schematic diagram of a track beam according to an embodiment of the disclosure.

As shown in FIG. 10, in some embodiments of the disclosure, an anti-slip layer 22 is disposed on a surface of the flange plate 2 associated with the road wheel 71. That is to say, the anti-slip layer 22 is disposed on the surface of the flange plate 2 associated with the road wheel 71, to cause the road wheel 71 to better travel on the flange plate 2. The anti-slip layer 22 may be an anti-slip coating, an anti-slip pattern, or the like disposed on the upper surface of the flange plate 2.

As shown in FIG. 1 to FIG. 9, the track beam 1000 for a rail vehicle 7 according to the embodiments of the disclosure includes a plurality of track beam units 100. The plurality of track beam units 100 are connected in sequence in a length direction of the track beam units 100, and the track beam units 100 are the track beam units 100 in the embodiments of the disclosure.

According to the track beam 1000 for a rail vehicle 7 in the embodiments of the disclosure, the track beam 1000 includes the plurality of track beam units 100 connected in sequence. It may be understood that the track beam units are connected in sequence in the length direction of the track beam units 100 (a Y-axis direction shown in FIG. 3). The flange plate 2 of each guide rail beam 10 is supported on the fixing plate 1 by using the web plate 3, thereby ensuring that the flange plate 2 can stably support the lower part of the rail vehicle 7. The web plate 3 is connected with a lower part of the flange plate 2. The association of the guide wheel 72 and the web plate 3 may guarantee that the traveling track of the rail vehicle 7 does not deviate while the rail vehicle 7 is smoothly traveling on the track beam 1000. Therefore, the track beam unit 100 of the disclosure is more applicable to the rail vehicle 7. In addition, each guide rail beam 10 is simple in structure and easy to machine, and saves materials. The track beam 1000 of the disclosure may be prefabricated at the factory and assembled on site, thereby achieving a short engineering cycle, strong adaptability, and convenient transportation.

In the descriptions of this specification, descriptions using reference terms "an embodiment", "some embodiments", "an exemplary embodiment", "an example", "a specific example", or "some examples" mean that specific characteristics, structures, materials, or features described with reference to the embodiment or example are included in at least one embodiment or example of the disclosure. In this specification, schematic descriptions of the foregoing terms do not necessarily point at a same embodiment or example. In addition, the described specific features, structures, materials, or characteristics may be combined in a proper manner in any one or more of the embodiments or examples.

Some embodiments of this application have been shown and described, and persons of ordinary skill in the art should understand that various changes, modifications, replacements and variations may be made to the embodiments without departing from the principles and spirit of the disclosure, and the scope of the disclosure is as defined by the appended claims and their equivalents.

What is claimed is:

1. A guide rail beam for a rail vehicle, wherein the rail vehicle comprises a road wheel and a guide wheel located under the road wheel, and the guide rail beam comprises:

a fixing plate disposed on a mounting surface;

a flange plate, disposed above the fixing plate, wherein the road wheel is configured to travel on the flange plate;

a web plate comprising a first surface and a second surface, wherein an upper end of the web plate is connected with the flange plate, a lower end of the web plate is connected with the fixing plate, the first surface and the second surface are exposed, and the web plate is in contact with and be associated with the guide wheel to guide a traveling track of the guide wheel; and a stiffening rib, wherein the stiffening rib is exposed, an upper end of the stiffening rib is connected with the flange plate, and a lower end of the stiffening rib is connected with the fixing plate.

2. The guide rail beam according to claim 1, wherein a width direction of the stiffening rib is parallel to a width direction of the guide rail beam.

3. The guide rail beam according to claim 1, wherein the stiffening rib is connected with the first surface or the second surface of the web plate.

4. The guide rail beam according to claim 3, wherein a plurality of stiffening ribs are disposed; and the plurality of stiffening ribs are spaced apart from each other in a length direction of the guide rail beam.

5. The guide rail beam according to claim 1, wherein a limiting flange is disposed on the flange plate, and is located above the guide wheel.

6. The guide rail beam according to claim 1, wherein in a width direction of the guide rail beam, the web plate is disposed off a width center of the flange plate.

7. A track beam unit for a rail vehicle, comprising two guide rail beams, wherein the two guide rail beams are spaced apart from each other in a width direction of the rail vehicle, the rail vehicle comprises a road wheel and a guide wheel located under the road wheel, and each of the guide rail beams comprises:

a fixing plate, disposed on a mounting surface;

a flange plate disposed above the fixing plate, wherein the road wheel travels on the flange plate;

a web plate comprising a first surface and a second surface, wherein an upper end of the web plate is connected with the flange plate, a lower end of the web plate is connected with the fixing plate, the first surface and the second surface are exposed, and the web plate is in contact with and be associated with the guide wheel to guide a traveling track of the guide wheel;

a stiffening rib, wherein the stiffening rib is exposed, an upper end of the stiffening rib is connected with the flange plate, and a lower end of the stiffening rib is connected with the fixing plate; and a connecting member, wherein a first end of the connecting member is connected with a stiffening rib of a first guide rail beam of the two guide rail beams, and a second end of the connecting member is connected with a stiffening rib of a second guide rail beam of the two guide rail beams.

8. The track beam unit according to claim 7, wherein the first end of the connecting member is further connected with a web plate of the first guide rail beam of the two guide rail beams, and the second end of the connecting member is further connected with a web plate of a second guide rail beam of the two guide rail beams.

9. The track beam unit according to claim 8, comprising a plurality of connecting members and a plurality of stiffening ribs, wherein a number of the plurality of connecting members is the same as a number of the plurality of stiffening ribs of each of the guide rail beams.

10. The track beam unit according to claim 8, wherein a reinforcing plate is disposed on the stiffening rib.

11. The track beam unit according to claim 10, wherein the reinforcing plate comprises an upper plate body and a lower plate body, the connecting member is an I-shaped steel member, the upper plate body is flush with an upper flange of the connecting member, and the lower plate body is flush with a lower flange of the connecting member.

12. The track beam unit according to claim 8, further comprising a supporting member, the supporting member is disposed on the connecting member, and an evacuation exit is defined by an upper space of the supporting member.

13. The track beam unit according to claim 12, wherein a cable channel is disposed in the evacuation exit, and is disposed close to the web plate.

14. The track beam unit according to claim 7, wherein an anti-slip layer is disposed on a surface of the flange plate associated with the road wheel.

15. The track beam unit according to claim 7, wherein the first end of the connecting member is further connected with a web plate of the first guide rail beam of the two guide rail beams, and the second end of the connecting member is further connected with a web plate of the second guide rail beam of the two guide rail beams.

16. The track beam unit according to claim 7, wherein a limiting flange is disposed on the flange plate, and is located above the guide wheel.

17. The track beam unit according to claim 7, wherein in a width direction of the two guide rail beams, the web plate is disposed off a width center of the flange plate.

18. A track beam for a rail vehicle, comprising a plurality of track beam units, wherein the plurality of track beam units are connected in sequence in length directions of the track beam units, and each of the track beam units comprising two guide rail beams, wherein the two guide rail beams are spaced apart from each other in a width direction of the rail vehicle, the rail vehicle comprises a road wheel and a guide wheel located under the road wheel, and each of the guide rail beams comprises:

a fixing plate disposed on a mounting surface;

a flange plate, disposed above the fixing plate, wherein the road wheel travels on the flange plate;

a web plate comprising a first surface and a second surface, wherein an upper end of the web plate is connected with the flange plate, a lower end of the web plate is connected with the fixing plate, the first surface and the second surface are exposed, and the web plate is in contact with and be associated with the guide wheel to guide a traveling track of the guide wheel;

a stiffening rib, wherein the stiffening rib is exposed, an upper end of the stiffening rib is connected with the flange plate, and a lower end of the stiffening rib is connected with the fixing plate; and a connecting member, wherein a first end of the connecting member is connected with a stiffening rib of a first guide rail beam of the two guide rail beams, and a second end of the connecting member is connected with a stiffening rib of a second guide rail beam of the two guide rail beams.

19. The track beam according to claim 18, wherein a limiting flange is disposed on the flange plate, and is located above the guide wheel.

20. The track beam according to claim 18, wherein in a width direction of the two guide rail beams, the web plate is disposed off a width center of the flange plate.

* * * * *